US008155966B2

(12) United States Patent
Toda et al.

(10) Patent No.: US 8,155,966 B2
(45) Date of Patent: Apr. 10, 2012

(54) APPARATUS AND METHOD FOR PRODUCING AN AUDIBLE SPEECH SIGNAL FROM A NON-AUDIBLE SPEECH SIGNAL

(75) Inventors: Tomoki Toda, Ikoma (JP); Mikihiro Nakagiri, Ikoma (JP); Hideki Kashioka, Ikoma (JP); Kiyohiro Shikano, Ikoma (JP)

(73) Assignee: National University Corporation Nara Institute of Science and Technology, Ikoma-shi (JP)

( * ) Notice: Subject to any disclaimer, the term of this patent is extended or adjusted under 35 U.S.C. 154(b) by 524 days.

(21) Appl. No.: 12/375,491

(22) PCT Filed: Feb. 7, 2007

(86) PCT No.: PCT/JP2007/052113

§ 371 (c)(1),
(2), (4) Date: Jan. 28, 2009

(87) PCT Pub. No.: WO2008/015800

PCT Pub. Date: Feb. 7, 2008

(65) Prior Publication Data

US 2009/0326952 A1 Dec. 31, 2009

(30) Foreign Application Priority Data

Aug. 2, 2006 (JP) ..... 2006-211351

(51) Int. Cl.
*G10L 13/02* (2006.01)
*G10L 13/00* (2006.01)

(52) U.S. Cl. ..... 704/269; 704/258; 704/266; 381/151

(58) Field of Classification Search ..... None
See application file for complete search history.

(56) References Cited

U.S. PATENT DOCUMENTS 7,010,139 B1 * 3/2006 Smeehuyzen ..... 381/380

(Continued)

FOREIGN PATENT DOCUMENTS

JP 04316300 11/1992

(Continued)

OTHER PUBLICATIONS

Tomoki Toda et al. "NAM-to-Speech Conversion Based on Gaussian Mixture Model", The Institute of Electronics, Information and Communication Engineers (IEICE) Shingakugiho, SP2004-107, pp. 67-72, Dec. 2004.

(Continued)

*Primary Examiner* — Matthew Sked
(74) *Attorney, Agent, or Firm* — Edwards Wildman Palmer LLP

(57) ABSTRACT

[Problems]
To convert a signal of non-audible murmur obtained through an in-vivo conduction microphone into a signal of a speech that is recognizable for (hardly misrecognized by) a receiving person with maximum accuracy.
[Means for Solving Problems]
A speech processing method comprising: a learning step (S7) for conducting a learning calculation of a model parameter of a vocal tract feature value conversion model indicating conversion characteristic of acoustic feature value of vocal tract, on the basis of a learning input signal of non-audible murmur recorded by an in-vivo conduction microphone and a learning output signal of audible whisper corresponding to the learning input signal recorded by a prescribed microphone, and then, storing a learned model parameter in a prescribed storing means; and a speech conversion step (S9) for converting a non-audible speech signal obtained through an in-vivo conduction microphone into a signal of audible whisper, based on a vocal tract feature value conversion model, with a learned model parameter obtained through the learning step set thereto.

6 Claims, 7 Drawing Sheets

U.S. PATENT DOCUMENTS

| | | | | |
|---|---|---|---|---|
| 7,778,430 | B2 * | 8/2010 | Nakajima et al. | 381/151 |
| 2002/0141602 | A1 | 10/2002 | Nemirovski | |
| 2005/0244020 | A1 | 11/2005 | Nakajima et al. | |
| 2006/0167691 | A1 * | 7/2006 | Tuli | 704/258 |

FOREIGN PATENT DOCUMENTS

| | | |
|---|---|---|
| JP | 10254473 | 9/1998 |
| JP | 2004525572 | 8/2004 |
| JP | 2006-86877 | 3/2006 |
| JP | 2006-126558 | 5/2006 |
| WO | WO-2004021738 | 3/2004 |

OTHER PUBLICATIONS

Tomoki Toda, "A Maximum Likelihood Mapping Method and Its Application", The Institute of Electronics, Information and Communication Engineers (IEICE) Shingakugiho, SP2005-147, pp. 49-54, Jan. 2006.

Tomoki Toda et al., "NAM-to-Speech Conversion with Gaussian Mixture Models," Proceedings of INTERSPEECH 2005, pp. 1957-1960, Sep. 4-8, 2005, Lisbon, Portugal.

* cited by examiner

Fig.6

| | | Word answering accuracy[%] | Average number of times of listening again |
|---|---|---|---|
| | Normal speech | 94.13 | 1.91 |
| | Whisper | 91.08 | 2.09 |
| | NAM | 45.25 | 4.33 |
| Conversion speech | NAM to normal speech | **69.79** | **3.23** |
| | NAM to whisper | **75.71** | **3.03** |

APPARATUS AND METHOD FOR PRODUCING AN AUDIBLE SPEECH SIGNAL FROM A NON-AUDIBLE SPEECH SIGNAL

CROSS-REFERENCE TO PRIOR APPLICATION

This is the U.S. National Phase Application under 35 U.S.C. §371 of International Patent Application No. PCT/JP2007/052113 filed Feb. 7, 2007, which claims the benefit of Japanese Patent Application No. 2006-211351 filed Aug. 2, 2006, both of which are incorporated by reference herein. The International Application was published in Japanese on Feb. 7, 2008 as WO2008/015800 A1 under PCT Article 21(2).

BACKGROUND OF THE INVENTION

1. Field of the Invention

The present invention relates to a speech processing method for converting a non-audible speech signal obtained through an in-vivo conduction microphone into an audible speech signal, a speech processing program for a processor to execute the speech processing, and a speech processing device for executing the speech processing.

2. Description of the Related Art

LIST OF CITED LITERATURES

Patent Literature 1: WO 2004/021738

Patent Literature 2: Japanese Unexamined Patent Publication No. 2006-086877

Nonpatent Literature 1: Tomoki TODA et al. "NAM-to-Speech Conversion Based on Gaussian Mixture Model", The Institute of Electronics, Information and Communication Engineers (IEICE) Shingakugiho, SP2004-107, pp. 67-72, December 2004

Nonpatent Literature 2: Tomoki TODA, "A Maximum Likelihood Mapping Method and Its Application", The Institute of Electronics, Information and Communication Engineers (IEICE) Shingakugiho, SP2005-147, pp. 49-54, January 2006

In these days, due to the penetration of mobile-phones and communication networks for mobile-phones, verbal communication with other people is possible anytime, anywhere.

On the other hand, there are environments such as in trains and libraries where sound production is restricted for the purpose of such as the nuisance prevention for those around and the confidentiality of the content of conversations. If verbal communication can be performed through such as mobile-phones without leaking the content of a sound production to those around, on-demand verbal communication is further promoted in environments where sound productions are restricted, and thereby making various practices efficient.

And also, a person having disability in the pharyngeal part, such as the vocal cords, can often perform, if not a sound production of ordinary speech, a sound production of non-audible murmur. If such a person having disability in the pharyngeal part can have a conversation with other person through a sound production of non-audible murmur, the convenience may be improved drastically.

On the other hand, in the Patent Literature 1, a communication interface system which inputs speech by collection of non-audible murmurs (NAM) has been introduced. A non-audible murmur is an unvoiced sound without regular vibrations of the vocal cords, a breath sound that cannot be clearly heard from the outside, and a vibration sound conducted through in-vivo soft tissues. For example, in a sound proof room environment, a breath sound as a non-audible speech that is out of earshot of people away from a speaker about 1 to 2 m is defined as "non-audible murmur". In addition, an audible speech, that produces an unvoiced sound audible to people away from a speaker about 1 to 2 m by increasing the air flow speed passing through a vocal tract, with vocal tract, in particular, oral cavity narrowed, is defined as "audible whisper".

The signal of non-audible murmur cannot be collected by an ordinary microphone, which detects vibrations in the acoustical space. Therefore, the signal of non-audible murmur is collected through an in-vivo conduction microphone which collects in-vivo conducted sounds. As the in-vivo conduction microphone, there have been a tissue conductive microphone for collecting flesh conducted sounds inside of the living body, a so-called throat microphone for collecting conducted sounds in the throat, and a bone conductive microphone for collecting bone conducted sounds inside of the living body. To collect a non-audible murmur, a tissue conductive microphone is particularly suitable. This tissue conductive microphone is attached to a skin surface on stemocleidal papillary muscle, right below the mastoid bone of a skull in the lower part of an auricle, and collects flesh conducted sounds as a sound conducted through in-body soft compositions. The details of the tissue conductive microphone have been disclosed in the Patent Literature 1. Additionally, in-body soft compositions are such as muscles and fat, other than bones.

The non-audible murmur does not involves a regular vibration of the vocal cords. The non-audible murmur has therefore a problem that, even with the sound volume increased, the content of the speech is hardly heard by a receiving person.

In response, for example, the Nonpatent Literature 1 has disclosed a technology, in which, based on Gaussian Mixture Model as a model example of a statistical spectrum conversion method, a signal of non-audible murmur obtained through a NAM microphone such as the tissue conductive microphone is converted into a signal of a voiced sound as an ordinary sound production.

In addition, the Patent Literature 2 has disclosed a technology for estimating a fundamental frequency of a voiced sound as an ordinary sound production by comparison between signal powers of non-audible murmurs obtained through two NAM microphones, and converting a signal of non-audible murmur into a signal of the voiced sound based on the estimation result.

Employing the technologies disclosed in the Nonpatent Literature 1 and the Patent Literature 1 enables a signal of non-audible murmur obtained through an in-vivo conduction microphone to be converted into a signal of an ordinary voiced sound which is relatively easy to be heard by a receiving person.

In addition, as shown in the Nonpatent Literature 2, a technology has been well-known for sound quality conversion, in which, by using relatively less input speech signals and output speech signals for learning, a learning calculation of a parameter of a model based on a statistical spectrum conversion method (a model indicating a correlation between a feature value of an input speech signal and a feature value of an output speech signal) is conducted, so that, on the basis of the model with a learned parameter set thereto, an input signal as a speech signal is converted into an output signal as other speech signal having a different sound quality. The input signal here is the signal of non-audible murmur. Hereinafter, an input speech signal and output speech signal for learning are respectively called as a learning input speech signal and a learning output speech signal.

However, the non-audible murmur is an unvoiced sound without regular vibrations of the vocal cords. This is described in, for example, the Patent Literature 2. Conventionally, when converting the signal of non-audible murmur as an unvoiced sound into a signal of an ordinary speech, a speech conversion model which combines: a vocal tract feature value conversion model indicating the conversion characteristic of an acoustic feature value in a vocal tract, and a vocal cord feature value conversion model indicating the conversion characteristic of an acoustic feature value of the vocal cords as a sound source, has been employed. This is described in the Patent Literatures 1 and 2. Here, the conversion characteristic means a characteristic of conversion from a feature value of an input signal into a feature value of an output signal. The processing using the speech conversion model includes processing for producing the information about the fundamental frequency of voice, by estimating "existence" from "nonexistence". Therefore, the processing for converting the signal of non-audible murmur into a normal speech signal acquires a signal including a speech having unnatural intonation or an incorrect speech not originally vocalized, and thereby lowering the speech recognition rate of a receiving person.

The present invention has been completed on the basis of the above circumstances, with an object of providing: a speech processing method for converting a signal of non-audible murmur obtained through an in-vivo conduction microphone into a signal of a speech recognizable for a receiving person with maximum accuracy, in short, a signal of a speech hardly misrecognized by a receiving person, a speech processing program for a processor to execute the speech processing, and a speech processing device for executing the speech processing.

SUMMARY OF THE INVENTION

To attain the object suggested above, there is provided, according to one aspect of the present invention, a speech processing method for producing an audible speech signal based on and corresponding to an input non-audible speech signal, including each of steps described in the following (1) to (5).

Here, the input non-audible speech signal is a non-audible speech signal obtained through an in-vivo conduction microphone. In addition, to produce an audible speech signal based on and corresponding to the input non-audible speech signal means to convert the input non-audible speech signal into the audible speech signal.

(1) A calculating step of learning signal feature value for calculating a prescribed feature value of each of a learning input signal of non-audible speech recorded by the in-vivo conduction microphone and a learning output signal of audible whisper corresponding to the learning input signal recorded by a prescribed microphone (2) A learning step for performing learning calculation of a model parameter of a vocal tract feature value conversion model, which, on the basis of a calculation result of the calculating step of learning signal feature value, converts the feature value of a non-audible speech signal into the feature value of a signal of audible whisper, and then storing a learned model parameter in a prescribed memory (3) A calculating step of input signal feature value for calculating the feature value of the input non-audible speech signal (4) A calculating step of output signal feature value for calculating a feature value of a signal of audible whisper corresponding to the input non-audible speech signal, based on a calculation result of the calculating step of input signal feature value and the vocal tract feature value conversion model, with a learned model parameter obtained through the learning step set thereto (5) An output signal producing step for producing a signal of audible whisper corresponding to the input non-audible speech signal, on the basis of a calculation result of the calculating step of output signal feature value Here, a tissue conductive microphone is preferred to be used as the in-vivo conduction microphone, however, such as a throat microphone and a bone conductive microphone may be used. In addition, the vocal tract feature value conversion model is such as a model based on, for example, a well-known statistical spectrum conversion method. In this case, the calculating step of input signal feature value and the calculating step of output signal feature value are the steps for calculating a spectrum feature value of a speech signal.

As mentioned, the non-audible speech obtained through an in-vivo conduction microphone is an unvoiced sound without regular vibrations of the vocal cords. And also, an audible whisper as a speech generated through a so-called whispering is also an unvoiced sound without regular vibrations of the vocal cords, though being an audible sound. In short, both the signals of the non-audible speech and the audible whisper are a speech signal not including information of fundamental frequency. Consequently, the conversion from a non-audible speech signal into a signal of audible whisper through each of the above steps does not obtain a signal including an unnatural speech intonation or an incorrect speech not originally vocalized.

The present invention may be understood also as a speech processing program for a prescribed processor or a computer to execute the above-mentioned each step.

Similarly, the present invention can also be understood as a speech processing device for producing an audible speech signal based on and corresponding to an input non-audible speech signal as a non-audible speech signal obtained through an in-vivo conduction microphone. In this case, a speech processing device according to the present invention comprises each of the following elements (1) to (7).

(1) A learning output signal memory for storing a prescribed learning output signal of audible whisper (2) A learning input signal recording member for recording a learning input signal of non-audible speech input through the in-vivo conduction microphone as a signal corresponding to the learning output signal of audible whisper into a prescribed memory (3) A learning signal feature value calculator for calculating a prescribed feature value of each the learning input signal and the learning output signal: In addition, the prescribed feature value is, for example, a well-known spectrum feature value.

(4) A learning member for conducting a learning calculation of a model parameter of a vocal tract feature value conversion model which converts the feature value of a non-audible speech signal into the feature value of a signal of audible whisper based on a calculation result of the learning signal feature value calculator, and then conducting the processing for storing the learned parameter in a prescribed memory (5) An input signal feature value calculator for calculating the feature value of the input non-audible speech signal (6) An output signal feature value calculator for calculating a feature value of a signal of audible whisper corresponding to the input non-audible speech signal, based on a calculation result of the input signal feature value calculator and the vocal tract feature value conversion model, with a learned model parameter obtained by the learning member set thereto (7) An output signal producing member for producing a signal of audible whisper corresponding to the input non-audible speech signal based on a calculation result of the output signal feature value calculator A speech processing device comprising each of the above elements may achieve the same effect as of the above-mentioned speech processing method according to the present invention.

Here, a speaker of a speech of the learning input signal as a non-audible speech and a speaker of a speech of the learning output signal as the audible whisper are not necessarily the same person. However, it is preferred that both the speakers are the same person, or both the speakers have relatively similar vocal tract conditions and speaking manners, in view of enhancing the accuracy of speech conversion.

Then, a speech processing device according to the present invention may further comprise the element in the following (8).

(8) a learning output signal recording member for recording a learning output signal of audible whisper input through a prescribed microphone into the learning output signal memory This allows the combination of a speaker of a speech of the learning input signal as the non-audible speech and a speaker of a speech of the learning output signal as the audible whisper to be selected arbitrarily, thereby enhancing the accuracy of speech conversion.

According to the present invention, a non-audible speech signal can be converted into a signal of audible whisper with high accuracy, and furthermore, a signal including an unnatural speech intonation or an incorrect speech not originally vocalized cannot be obtained. As a result, it is understood that an audible whisper obtained through the present invention is a speech having a speech recognition rate of a receiving person higher than that of a general speech obtained through the conventional methods. Additionally, the general speech obtained through the conventional methods is a speech output on the basis of a signal of a general speech, that is converted from a non-audible speech signal based on a model combining a vocal tract feature value conversion model and a sound source feature value conversion model.

Moreover, according to the present invention, a learning calculation of a model parameter of a sound source model, as well as signal conversion processing based on the sound source feature value conversion model are not necessary, thereby reducing the arithmetic load. This allows high-speed learning calculation and speech conversion to be processed in real time even by a processor of a relatively low processing capacity mounted in a small-sized communication device such as a mobile-phone.

BRIEF DESCRIPTION OF THE DRAWINGS

FIG. 6 is a view showing an evaluation result on recognition easiness of an output speech of a speech processing device X;

DETAILED DESCRIPTION OF THE PREFERRED EMBODIMENTS

In what follows, with reference to the accompanying drawings, an embodiment of the present invention is set forth to provide sufficient understandings. In addition, these embodiments are mere examples of the present invention, and not intended to limit the technical scope of the present invention.

Figure 1:
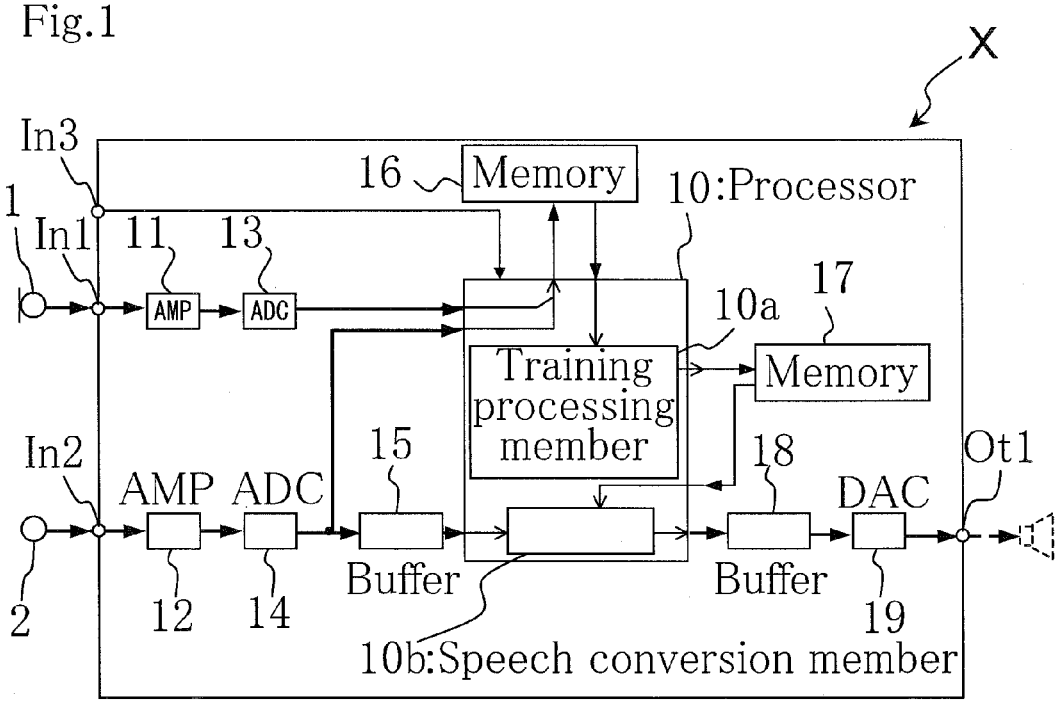
FIG. 1 is a block diagram showing a general configuration of a speech processing device X in accordance with an embodiment of the present invention.
Figure 2:
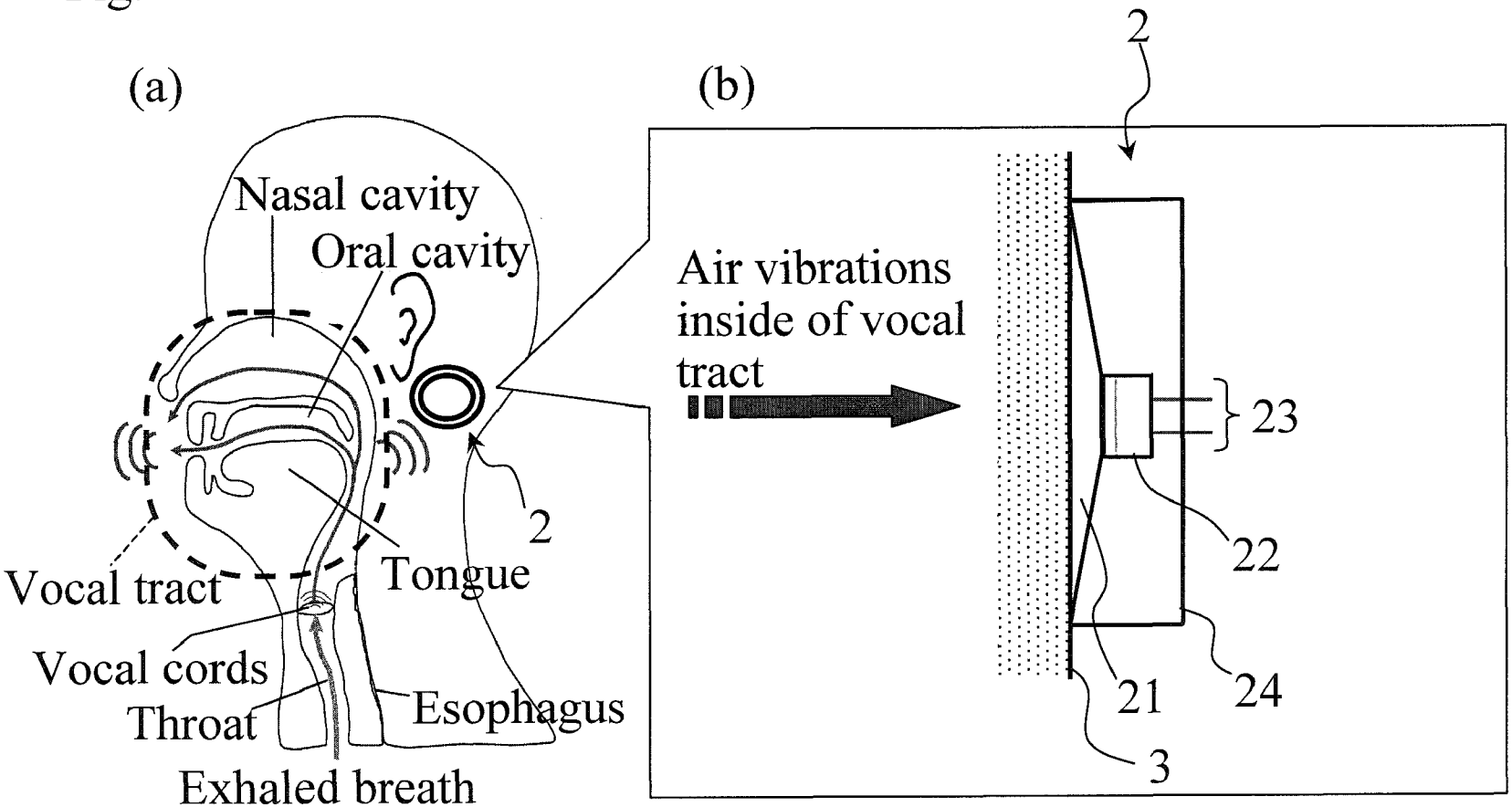
FIG. 2 shows a wearing state of a NAM microphone inputting a non-audible murmur, and a general cross-sectional view.
Figure 3:
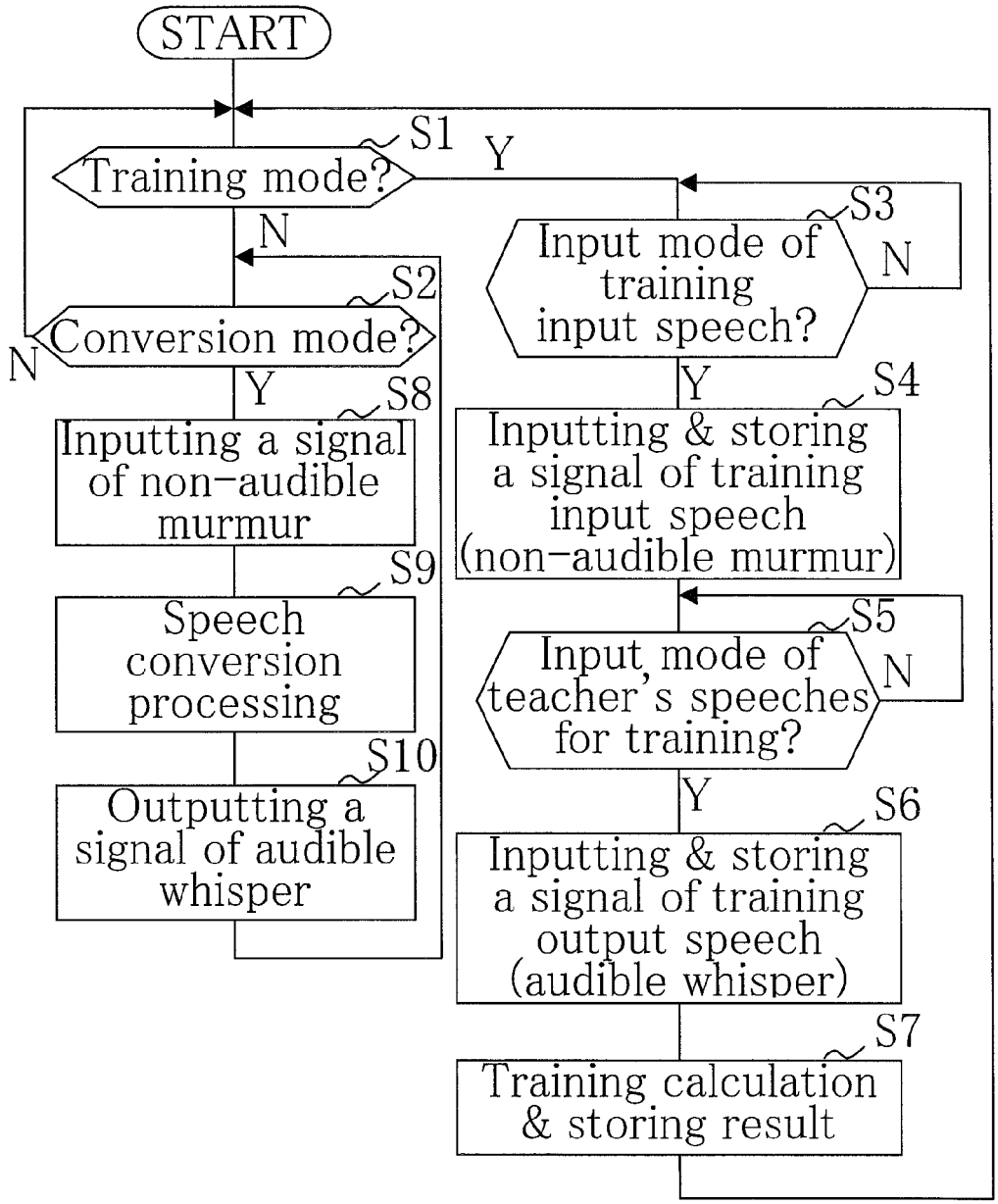
FIG. 3 is a flow chart showing steps of speech processing executed by a speech processing device X.
Figure 4:
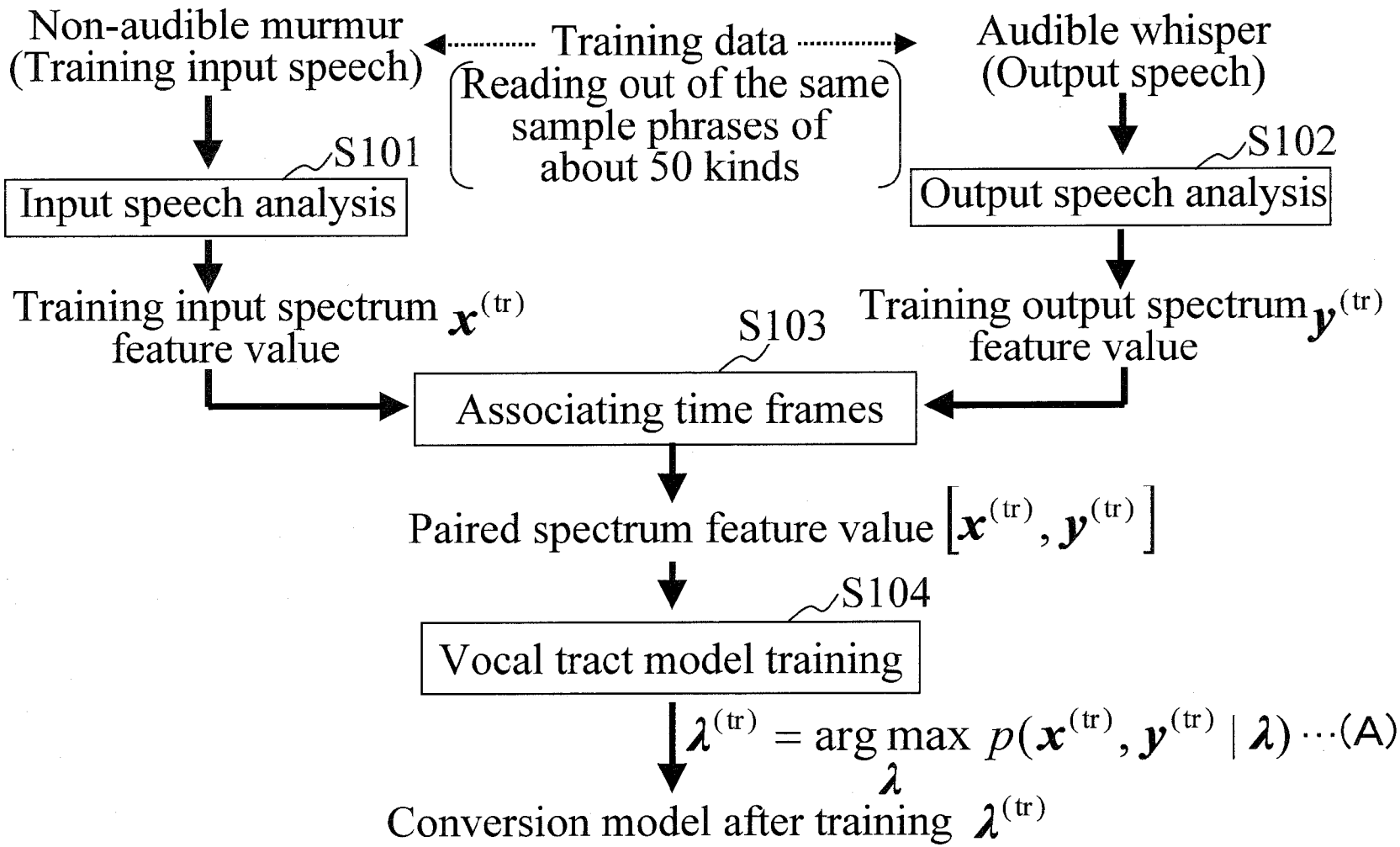
FIG. 4 is a general block diagram showing one example of learning processing of a vocal tract feature value conversion model executed by a speech processing device X.
Figure 5:
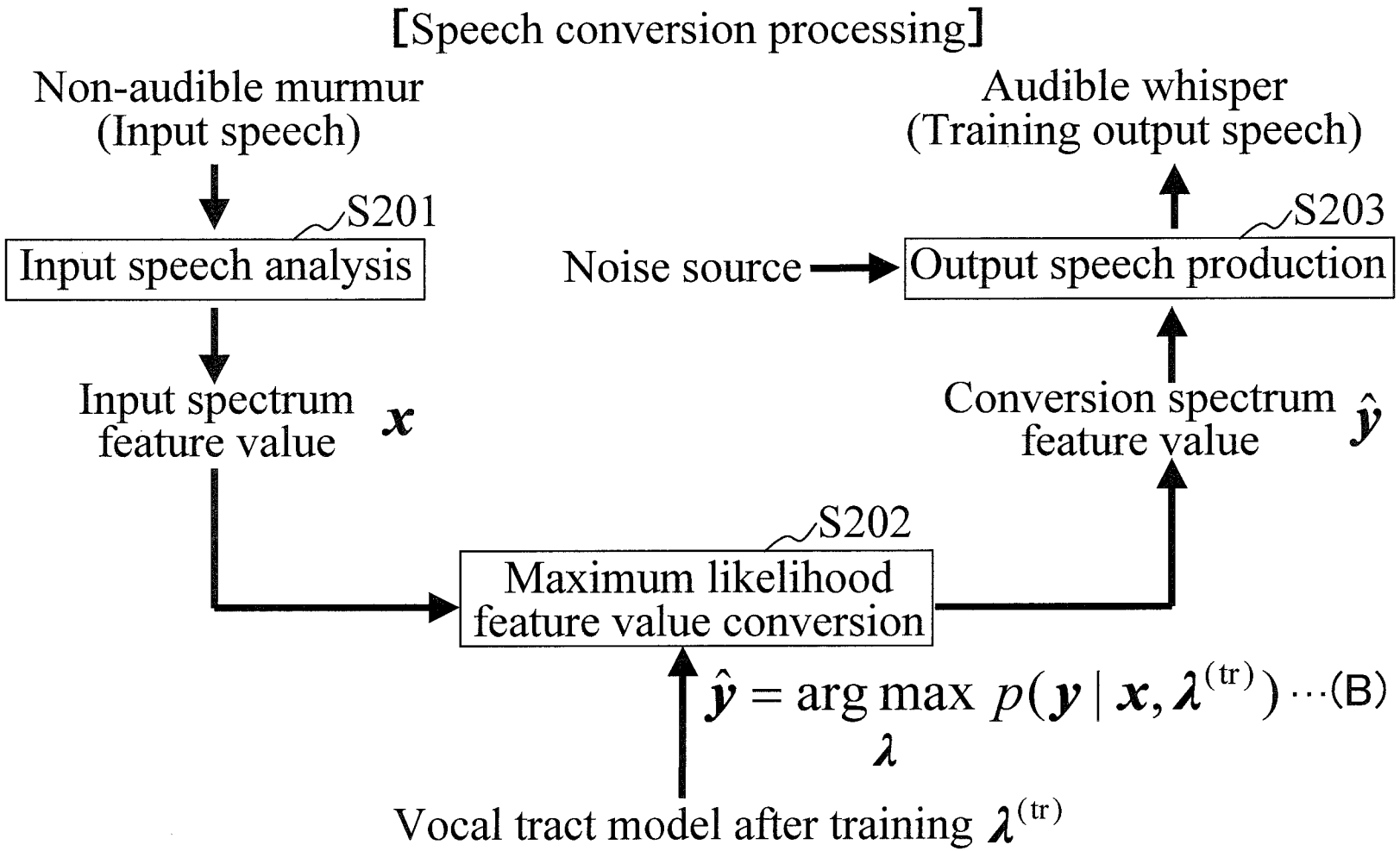
FIG. 5 is a general block diagram showing one example of speech conversion processing executed by a speech processing device X.
Figure 7:
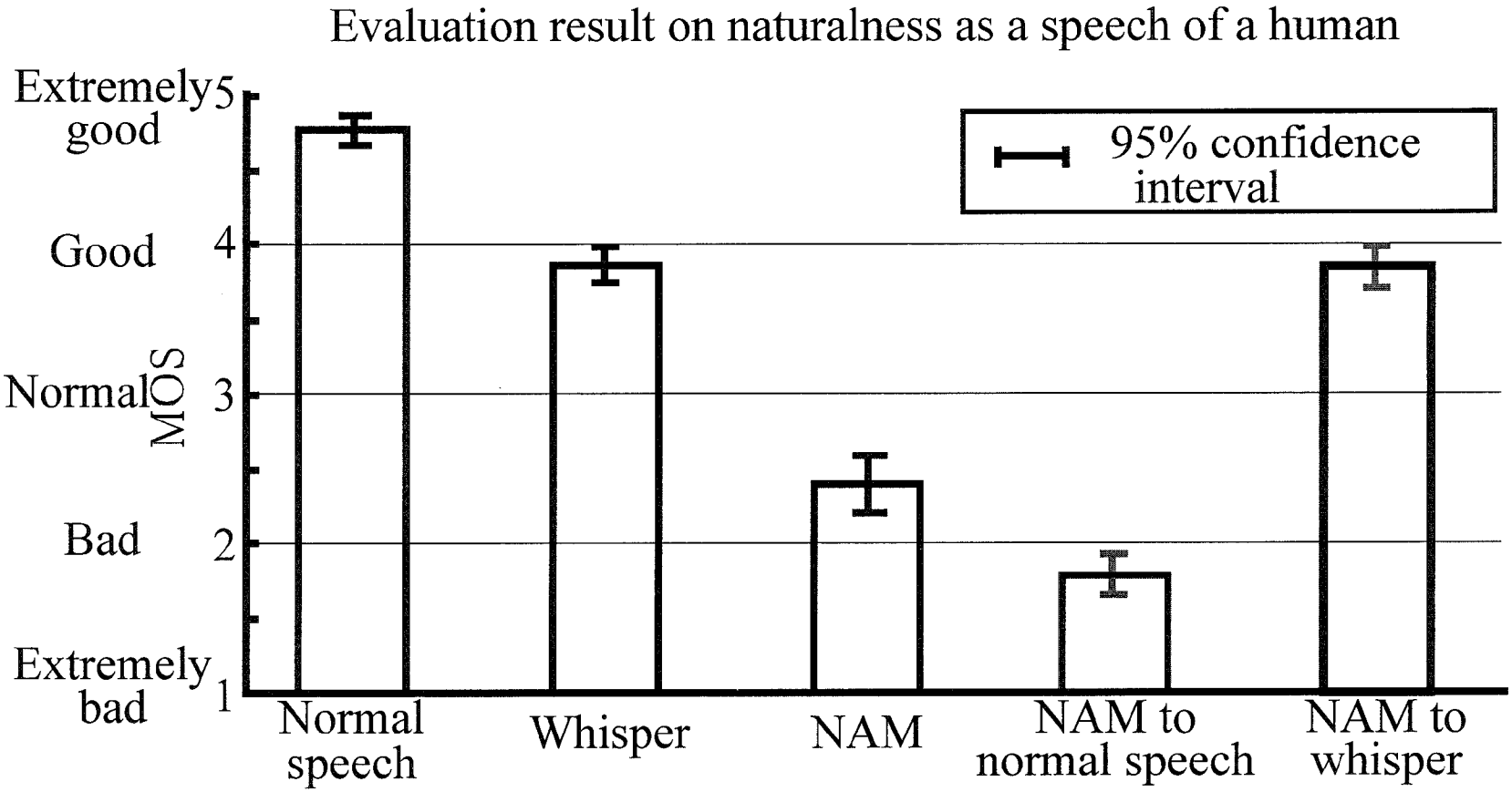
FIG. 7 is a view showing an evaluation result on naturalness of an output speech of a speech processing device X.

Here, FIG. 1 is a block diagram showing a general configuration of a speech processing device X in accordance with an embodiment of the present invention; FIG. 2 shows a wearing state of a NAM microphone inputting a non-audible murmur, and a general cross-sectional view; FIG. 3 is a flow chart showing steps of speech processing executed by a speech processing device X; FIG. 4 is a general block diagram showing one example of learning processing of a vocal tract feature value conversion model executed by a speech processing device X; FIG. 5 is a general block diagram showing one example of speech conversion processing executed by a speech processing device X; FIG. 6 is a view showing an evaluation result on recognition easiness of an output speech of a speech processing device X; and FIG. 7 is a view showing an evaluation result on naturalness of an output speech of a speech processing device X.

Firstly, as referring to FIG. 1, the configuration of a speech processing device 1 in accordance with embodiments of the present invention is described.

A speech processing device X executes the processing (method) for converting a signal of non-audible murmur obtained through a NAM microphone 2 into a signal of audible whisper. In addition, the NAM microphone 2 is an example of in-vivo conduction microphones.

As shown in FIG. 1, the speech processing device X comprises such as: a processor 10, two amplifiers 11 and 12, two A/D converters 13 and 14, a buffer for input signals 15, two memories 16 and 17, a buffer for output signals 18, and a D/A converter 19. Hereinafter, the two amplifiers 11 and 12 are respectively called as a first amplifier 11 and a second amplifier 12. The two A/D converters 13 and 14 are respectively called as a first A/D converter 13 and a second A/D converter 14. And the buffer for input signals 15 is called as an input buffer 15. Also, the two memories 16 and 17 are respectively called as a first memory 16 and a second memory 17. The buffer for output signals 18 is called as an output buffer.

Furthermore, the speech processing device X comprises: a first input terminal In1 for inputting a signal of audible whisper, a second input terminal In2 for inputting a signal of non-audible murmur, a third input terminal In3 for inputting various control signals, and an output terminal Ot1 for outputting a signal of audible whisper as a signal converted from a signal of non-audible murmur, that is input through the second input terminal In2, by a prescribed conversion processing.

The first amplifier 11 inputs a signal of audible whisper collected through an ordinary microphone, that detects vibrations of air in an acoustic space, through the first input terminal In1, and then amplifies this input signal. A signal of audible whisper to be input through the first input terminal In1 is a learning output signal used for learning calculation of a model parameter of the later described vocal tract feature value conversion model. Hereinafter, this signal is called as a learning output signal of audible whisper.

In addition, the first A/D converter 13 is for converting the learning output signal of audible whisper (analog signal), which was amplified by the first amplifier 11, into a digital signal at a prescribed sampling period.

The second amplifier 12 inputs the signal of non-audible murmur, that is input through the NAM microphone 2, through the second input terminal In2, and then amplifies the input signal. In some cases, the signal of non-audible murmur input through the second input terminal In2 is a learning input signal to be used for learning calculation of model parameters in the later described vocal tract feature value conversion model, while in the other cases, is a signal subject to the conversion into a signal of audible whisper. Hereinafter, the former signal is called as a learning output signal of non-audible murmur.

In addition, the second A/D converter 14 converts an analog signal as a signal of non-audible murmur amplified by the second amplifier 12 into a digital signal at a prescribed sampling period.

The input buffer 15 temporarily records a signal of non-audible murmur digitized by the second A/D converter 14 for an amount of a prescribed number of samples.

The first memory 16 is a readable and writable memory, for example, such as a RAM and a flash memory. The first memory 16 stores the learning output signal of audible whisper digitized by the first A/D converter 13 and the learning input signal of non-audible murmur digitized by the second A/D converter 14.

The second memory 17 is a readable and writable nonvolatile memory such as, for example, a flash memory and an EEPROM. The second memory 17 stores various information related to the conversion of speech signals. Additionally, the first memory 16 and the second memory 17 may be the same shared memory. However, such a shared memory is preferred to be a nonvolatile memory so that the later described model parameters after learning will not disappear due to the stop of the power distribution.

The processor 10 is a computing member such as, for example, a DSP (Digital Signal Processor) and an MPU (Micro Processor Unit), and realizes various functions by executing the programs preliminarily stored in a ROM not shown.

For example, the processor 10 conducts learning calculation of a model parameter of a vocal tract feature value conversion model by executing a prescribed learning processing program, and stores the model parameters as a learning result in the second memory 17. Hereinafter, the section in processor 10 that is involved in execution of the learning calculation is called as a learning processing member 10*a* for convenience. In the learning calculation of this learning processing member 10*a*, the learning input signal of non-audible murmur as a learning signal stored in the first memory 16 and the learning output signal of audible whisper are used.

Furthermore, the processor 10 converts, by executing a prescribed speech conversion programs, a signal of non-audible murmur obtained through the NAM microphone 2 into a signal of audible whisper, on the basis of a vocal tract feature value conversion model with a model parameter after learning of the learning processing member 10*a* set thereto, and then outputs the converted speech signal to the output buffer 18. The signal of non-audible murmur is an input signal through the second input terminal In2. Hereinafter, the section in the processor 10 that is involved in execution of the speech conversion processing is called as a speech conversion member 10*b* for convenience.

Next, as referring now to the schematic cross sectional view shown in FIG. 2(*b*), the general configuration of the NAM microphone 2 used for collecting a signal of non-audible murmur is described.

The NAM microphone 2 is a tissue conductive microphone for collecting a vibration sound, that is a speech without regular vibrations of the vocal cords, non-audible from the outside, and conducted through in-vivo soft tissues. Additionally, a vibration sound conducted through in-vivo soft tissues may be called, in other words, as a flesh conducted breath sound. And also, the NAM microphone 2 is one example of in-vivo conduction microphones.

As illustrated in FIG. 2(*b*), the NAM microphone 2 comprises: a soft-silicon member 21, a vibration sensor 22, a sound isolation cover 24 covering these, and an electrode 23 provided in the vibration sensor 22.

The soft-silicon member 21 is a soft member contacting with a skin 3 of a speaker and made of silicon here. The soft-silicon member 21 is a medium for delivering vibrations, which generate as air vibrations inside of the vocal tract of the speaker and are conducted through the skin 3, to the vibration sensor 22. In addition, the vocal tract includes the respiratory tract section in the downstream than the vocal cords in the exhaling direction, in short, the oral cavity and the nasal cavity, and is extending to the lips.

The vibration sensor 22 contacts with the soft-silicon member 21, so as to be an element for converting a vibration of the soft-silicon member 21 into an electrical signal. The electrical signal this vibration sensor 22 obtains is transmitted to the outside through the electrode 23.

The sound isolation cover 24 is a soundproof material for preventing vibrations, that are delivered through the surrounding air other than the skin 3 contacting with the soft-silicon member 21, from being transmitted to the soft-silicon member 21 and the vibration sensor 22.

The NAM microphone 2, as illustrated in FIG. 2(*a*), is wore so that the soft-silicon member 21 comes to contact with the skin surface on stemocleidal papillary muscle right below mastoid bones of a skull in the lower part of auricle of the speaker. This allows the vibrations generated in the vocal tract, in short, the vibrations of non-audible murmur to be delivered to the soft-silicon member 21 through the flesh part without bones in a speaker in a nearly-shortest period of time.

Next, as referring to the flowchart in FIG. 3, steps of speech processing the speech processing device X executes are explained. Hereinafter, S1 and S2 are identifying codes of processing steps.

[Steps S1 and S2]

Firstly, the processor 10 judges whether the operation mode of the present speech processing device X is set to the learning mode (S1) or to the conversion mode (S2) on the basis of the control signals input through the third input terminal In3, while waiting ready. The control signals are what a communication device such as a mobile-phone outputs to the present speech processing device X, in accordance with the input operation information indicating an operational state of a prescribed operation input member such as operation keys. The communication device is, for example, such as a device mounting the present speech processing device X and a device connected to the present speech processing device X, and hereinafter called as an applied communication device.

[Steps S3 and S4]

When the processor 10 judges that the operation mode is the learning mode, then monitors the inputting state of the control signals through the third input terminal In3, and waits ready until the operation mode is set to a prescribed input mode of learning input speech (S3).

Here, when the processor 10 judges that the operation mode is set to the input mode of learning input speech, then inputs the learning input signal of non-audible murmur, that is input through the NAM microphone 2, through the second amplifier 12 and the second A/D converter 14, and then records the input signal into the first memory 16 (S4: one example of a learning input signal recording member).

When the operation mode is in the input mode of learning input speech, the user of the applied communication device reads out in a non-audible murmur, for example, sample phrases as predetermined learning phrases about 50 kinds respectively, wearing the NAM microphone 2. This allows a signal of learning input speech as a non-audible murmur corresponding respectively to the sample phrases to be stored in the first memory 16. Hereinafter, the user of the applied communication device is called as a speaker.

In addition, the distinction of a speech corresponding to each the sample phrase is achieved by, for example, the processor 10 that detects a distinctive signal input through the third input terminal In3 in accordance with the operation of the applied communication device or a silent period inserted between readings of each the sample phrase.

[Steps S5 and S6]

Next, the processor 10 monitors the inputting state of the control signal through the third input terminal In3, and then waits ready until the operation mode is set to a prescribed input mode of learning output speech (S5).

Here, when the processor 10 judges that the operation mode is set to the input mode of learning output speech, then inputs the learning output signal of audible whisper, that is input through the microphone 1, through the first amplifier 11 and the first A/D converter 13, and then records the input signal into the first memory 16 (S6: one example of a learning output signal recording member) The first memory 16 is one example of a learning output signal memory. And also, the microphone 1 is an ordinary microphone which collects speeches conducted in an acoustic space. The learning output signal of audible whisper is a digital signal corresponding to a learning input signal obtained in the step S4.

When the operation mode is set to the input mode of learning output speech, the speaker reads out the sample phrases respectively in an audible whisper, with his/her lips close to the microphone 1. The sample phrases are learning phrases and the same as what are used in the step S4.

According to the processing in steps S3 to S6 described in the above, the learning input signal of non-audible murmur recorded through the NAM microphone 2 and the learning output signal of audible whisper corresponding thereto are mutually related and stored in the first memory 16. In addition, the learning input signal of non-audible murmur and the learning output signal of audible whisper, which are obtained by reading out the same sample phrases, are related mutually.

It is preferred, for the purpose of enhancing the accuracy of speech conversion, that the speaker giving a speech of the learning input signal as a non-audible speech in the step S4 is the same speaker as the person who gives a speech of the learning output signal as an audible whisper in the step S6.

However, the speaker as a user of the present speech processing device X may not be able to vocalize an audible whisper sufficiently due to, for example, such as the disability in pharyngeal part. In such a case, a person other than the user may become a speaker to give a speech of the learning output signal as an audible whisper in the step S6. In this case, the person producing a speech of the learning output signal in the step S6 is preferred to be a person who has a relatively similar way of speaking or vocal tract condition to the user of the present speech processing device X, in short, the speaker in the step S4, for example, such as a blood related person.

In addition, when a signal of a speech of the sample phrases for learning, which a given person read out in an audible whisper, is preliminarily stored in the first memory 16 as a nonvolatile memory, the processing in the steps S5 and S6 may be omitted.

[Step S7]

Next, the learning processing member 10*a* in the processor 10 then acquires the learning input signal as well as the learning output signal stored in the first memory 16, and, on the basis of both the signals, conducts a learning calculation of a model parameter of a vocal tract feature value conversion model, while at the same time, executing learning processing for storing a learned model parameter in the second memory 17 (S7: one example of learning step). After that, the process returns to the fore-mentioned step S1. Here, the learning input signal is a signal of non-audible murmur, and the learning output signal is a signal of audible whisper. In addition, the vocal tract feature value conversion model converts a feature value of a non-audible speech signal into a feature value of a signal of audible whisper, and expresses a conversion characteristic of an acoustic feature value of vocal tract. For example, the vocal tract feature value conversion model is a model based on a well-known statistical spectrum conversion method. Here, when the vocal tract feature value conversion model based on a statistical spectrum conversion method is employed, a spectrum feature value is employed as a feature value of a speech signal. The content of the learning processing (S7) is explained as referring to the block diagram shown in FIG. 4 (steps S101 to S104).

FIG. 4 is a general block diagram showing one example of learning processing (S7: S101 to S104) of the vocal tract feature value conversion model executed by the learning processing member 10*a*. FIG. 4 shows an example of learning processing when the vocal tract feature value conversion model is a spectrum conversion method based on a statistical spectrum conversion method.

The learning processing member 10*a* firstly conducts an automatic analysis processing of the learning input signal, in short, an input speech analysis processing including such as FFT in a learning processing of the vocal tract feature value conversion model, so that a spectrum feature value of a learning input signal is calculated (S101). Hereinafter, the spectrum feature value of a learning input signal is called as a learning input spectrum feature value $x^{(tr)}$.

Here, the learning processing member 10*a* calculates, for example, a melcepstrum coefficient from order 0 to order 24 obtained from a spectrum of the entire frame in the learning input signal as the learning input spectrum feature value $x^{(tr)}$.

Or, the learning processing member 10*a* may detect a frame, which has a normalized power in the learning input signal greater than a prescribed setting power, as a voiced period, and may then calculate a melcepstrum coefficient from order 0 to order 24 obtained from a spectrum of the frame in the above voiced period as the learning input spectrum feature value $x^{(tr)}$.

Furthermore, the learning processing member 10*a* calculates the spectrum feature value of a learning output signal by conducting an automatic analysis processing of the learning output signal, in short, an input speech analysis processing including such as FFT (S102). Hereinafter, the spectrum feature value of a learning output signal is called as a learning output spectrum feature value $y^{(tr)}$.

Here, similar to the step S01, the learning processing member 10*a* calculates a melcepstrum coefficient from order 0 to order 24 obtained from a spectrum of the entire frame in the learning output signal as the learning output spectrum feature value $y^{(tr)}$.

Or, the learning processing member 10*a* may detect a frame, which has a normalized power in the learning output signal greater than a prescribed setting power, as a voiced period, and may then calculate a melcepstrum coefficient from order 0 to order 24 obtained from a spectrum of the frame in the above voiced period as the learning output spectrum feature value $y^{(tr)}$.

In addition, the steps S101 and S102 are one example of a calculating step of learning signal feature value for calculating a prescribed feature value, regarding respectively the learning input signal and the learning output signal. Here, the prescribed feature value is a spectrum feature value.

Next, the learning processing member 10*a* executes a time frame associating processing for associating each the learning input spectrum feature value $x^{(tr)}$ obtained in the step S101 with each the learning output spectrum feature value $y^{(tr)}$ obtained in the step S102 (S103). This time frame associating processing associates each the learning input spectrum feature value $x^{(tr)}$ with each the learning output spectrum feature value $y^{(tr)}$, on condition that the positions of the original signals respectively corresponding to feature values $x^{(tr)}$ and $y^{(tr)}$ in a time axis are coincided. The processing in this step S103 obtains a paired spectrum feature values associating each the learning input spectrum feature value $x^{(tr)}$ with each the learning output spectrum feature value $y^{(tr)}$.

In the end, the learning processing member 10*a* conducts a learning calculation of a model parameter $\lambda$ in the vocal tract feature value conversion model indicating conversion characteristic of acoustic feature value of vocal tract, and then stores the learned model parameter in the second memory 17 (S104). In this step S104, a learning calculation of a parameter $\lambda$ in the vocal tract feature value conversion model is conducted, so that the conversion from each the learning input spectrum feature value $x^{(tr)}$ into each the learning output spectrum feature value $y^{(tr)}$ associated in the step S103 is performed within a prescribed error range.

Here, the vocal tract feature value conversion model according to the present embodiment is Gaussian Mixture Model (GMM). The learning processing member 10*a* conducts a learning calculation of a model parameter $\lambda$ in the vocal tract feature value conversion model based on a formula (A) shown in FIG. 4. Additionally, in the formula (A), $\lambda^{(tr)}$ is a model parameter of the vocal tract feature value conversion model, in short, Gaussian Mixture Model after learning, and $p(x^{(tr)}, y^{(tr)}|\lambda)$ expresses a likelihood of Gaussian Mixture Model regarding the learning input spectrum feature value $x^{(tr)}$ and the learning output spectrum feature value $y^{(tr)}$. The Gaussian Mixture Model indicates a joint probability density of each feature value.

This formula (A) calculates a model parameter $\lambda^{(tr)}$ after leaning, so that the likelihood $p(x^{(tr)}, y^{(tr)}|\lambda)$ of Gaussian Mixture Model indicating a joint probability density of the input/output spectrum feature values is maximized relative to each of spectrum feature values $x^{(tr)}$ and $y^{(tr)}$ of the learning input/output signals. Setting the calculated model parameter $\lambda$ to the vocal tract feature value conversion model allows a conversion equation of a spectrum feature value, in short, the vocal tract feature value conversion model after learning to be obtained.

[Steps S8 to S10]

On the other hand, judging that the operation mode is set to the conversion mode, the processor 10 inputs a signal of non-audible murmur, that is sequentially digitized by the second A/D converter 14, through the input buffer 15 (S8).

Furthermore, the speech conversion member 10*b* in the processor 10 executes speech conversion processing for converting an input signal as a signal of non-audible murmur into a signal of audible whisper by the vocal tract feature value conversion model learned in the step S7 (S9: one example of speech conversion step). The vocal tract feature value conversion model learned in the step S7 is the vocal tract feature value conversion model, with a learned model parameter set thereto. The content of this speech conversion processing (S9) is described later in reference to the block diagram shown in FIG. 5 (steps S201 to S203).

Further, the processor 10 outputs a converted signal of audible whisper to the output buffer 18 (S10). The processing in the above steps S8 to S10 is executed in real time while the operation mode is being set to the conversion mode. As a result, a signal of audible whisper, which is an analog signal converted by the D/A converter 19, is output to such as a speaker through the output terminal Ot1.

On the other hand, when the processor 10 confirms that the operation mode is set to other than the conversion mode during the processing in the steps S8 to S10, then returns to the fore-mentioned step S1.

FIG. 5 is a general block diagram showing one example of speech conversion processing (S9: S201 to S203) based on the vocal tract feature value conversion model executed by the speech conversion member 10*b*.

The speech conversion member 10*b*, similar to the step S101, firstly conducts, in the speech conversion processing, an automatic analysis processing of an input signal to be converted, in short, an input speech analysis processing including such as FFT, to calculate a spectrum feature value of the input signal (S201: one example of a calculating step of input signal feature value). The input signal is a signal of non-audible murmur. Hereinafter, a spectrum feature value of the input signal is called as an input spectrum feature value x.

Next, the speech conversion member 10*b* conducts a conversion processing of maximum likelihood feature value for converting a feature value x of an input signal of a non-audible speech, which is input through the NAM microphone 2, based on the vocal tract feature value conversion model $\lambda^{(tr)}$, with a learned model parameter obtained through the processing of the learning processing member 10*a* (S7) set thereto, into a feature value of a signal of audible whisper based on a formula (B) shown in FIG. 5 (S202). The vocal tract feature value conversion model $\lambda^{(tr)}$, with a learned model parameter set thereto is the vocal tract feature value conversion model after learning. Hereinafter, the feature value x of input signal is called as an input spectrum feature value x. And also, the left side of the formula (b) is a feature value of a signal of audible whisper, and hereinafter called as a conversion spectrum feature value.

In addition, this step S202 is one example of a calculating step of output signal feature value which, based on the calculation result of a feature value of an input signal, in short, the input non-audible speech signal and the vocal tract feature value conversion model, with a learned model parameter obtained by a learning calculation set thereto, calculates a feature value of a signal of audible whisper corresponding to the input signal.

Further, the speech conversion member 10*b* produces an output speech signal from the conversion spectrum feature value obtained in the step S202 by conducting a processing that is a reverse direction to the input speech analysis processing in the step S201 (S203: one example of an output signal producing step). The output speech signal is a signal of audible whisper. In such a case, the speech conversion member 10*b* produces the output speech signal by employing a signal of a prescribed noise source, such as a white noise signal, as an excitation source.

Additionally, in the above steps s101, S102, and S104, when the calculation of spectrum feature values $x^{(tr)}$ and $y^{(tr)}$ as well as the learning calculation of the vocal tract feature value conversion model λ are in process on the basis of a frame of a voiced period in a signal for learning, the speech conversion member 10*b* executes the processing in the steps S201 to S203 only for voiced periods in an input signal, and for other periods, outputs a silent signal. Here, the speech conversion member 10*b*, as mentioned above, distinguishes a voiced period and a silent period by judging whether or not a normalized power of each frame in an input signal is greater than a prescribed setting power.

Next, as referring to FIGS. 6 and 7, evaluation results on recognition easiness (FIG. 6) as well as on naturalness of an audible whisper as an output speech of the speech processing device X are explained.

Here, FIG. 6 shows the evaluation result when, with respect to each of a plurality of kinds of evaluating speeches composed of read out speeches of a prescribed evaluating phrase or conversed speeches corresponding thereto, a plurality of examinees are asked for listening evaluation, assuming 100% of answering accuracy of listened words as a full mark. Naturally, the evaluating phrases are different from the sample phrases used for the learning of a vocal tract feature value conversion model. The evaluating phrases are approximately 50 kinds of phrases in news paper articles in Japanese. And also, the examinees are adult Japanese. Additionally, the answering accuracy of words shows that the words in the original evaluating phrases are listened correctly.

The evaluating speeches are: each of speeches acquired when a speaker read out the evaluating phrases in "normal speech", "audible whisper", and "NAM (non-audible murmur)", "NAM to normal speech" acquired by converting such a non-audible murmur into a normal speech in a conventional method, and "NAM to whisper" acquired by converting such a non-audible murmur into an audible whisper with the speech processing device X. Any of these speeches are adjusted in volumes so as to be listened correctly. The sampling frequency of speech signals in the speech conversion processing is 16 kHz, while the frame shift is 5 ms.

And also, the conventional method is, as disclosed in the Nonpatent Literature 1, for converting a signal of non-audible murmur into a signal of normal speech by using a model combining the vocal tract feature value conversion model and the sound source model as a vocal cord model.

The FIG. 6 also includes a number of times when each grader listened again during the listening of the evaluating speeches. The number of times is an average number of the entire graders.

As shown in FIG. 6, it can be understood that the answering accuracy (75.71%) of "NAM to whisper" obtained by the speech processing device X is particularly improved compared with the answering accuracy (45.25%) of "NAM" as it is.

Also, the answering accuracy of "NAM to whisper" is also improved compared even with the answering accuracy (69.79%) of "NAM to normal speech" obtained by a conventional method.

One of the reasons is understood as that "NAM to normal speech" tends to accompany unnatural intonation, and is difficult to listen for the graders who are not used to the unnatural intonation, while on the other hand, "NAM to whisper" which does not generate intonation is relatively easy to listen. This can be seen from the result that the number of times "NAM to whisper" was listened again is smaller than that for "NAM to normal speech", and also, can be seen from the later described evaluation result on naturalness of speeches (FIG. 7).

And also, as other reasons, "NAM to normal speech" sometimes includes a speech not originally vocalized, in short, a speech of words not in the original evaluating phrases, and the word recognition rate of the graders is therefore drastically lowered. On the other hand, "NAM to whisper" does not involve a drastic lowering of a word recognition rate caused by such a reason.

In verbal communications, to accurately transmit words a speaker intends to send to a partner, in short, to achieve a high word recognition accuracy of a listener is the most important matter. In view of this, the conversion processing from a non-audible speech into an audible whisper as a speech processing according to the present invention is very advantageous relative to the conversion processing from a non-audible speech into a normal speech conducted by a conventional speech processing.

On the other hand, FIG. 7 shows a result of five-grade evaluation on the level how natural each the grader feels toward each evaluating speech mentioned above as a speech produced by a person. The five-grade evaluation has five grades from "1" for extremely low naturalness to "5" for extremely great naturalness, indicating average values of the entire graders.

As can be seen from FIG. 7, the naturalness of "NAM to whisper" (evaluated value≈3.8) obtained by the speech processing device X is dramatically higher than the naturalness of the non-audible murmur (evaluated value≈2.5).

On the other hand, the naturalness of "NAM to normal speech" (evaluated value≈1.8) obtained by a conventional method is not only lower than the naturalness of "NAM to whisper", but also decreased compared to the naturalness of the non-audible murmur as it is. This is because that converting the signal of non-audible murmur into a signal of normal speech acquires a speech having unnatural intonation.

As described in the above, according to the speech processing device X, a signal of non-audible murmur (NAM) obtained through the NAM microphone 2 can be converted into a signal of speech a receiving person can easily recognize, in short, hardly misrecognize.

In the above mentioned embodiment, an example is shown where a spectrum feature value as a feature value of speech signal is used, and Gaussian Mixture Model based on a statistical spectrum conversion method is used as the vocal tract feature value conversion model. However, as a model applicable as the vocal tract feature value conversion model in the present invention, other models, for example, such as a neural network model, that identify the input/output relationship by a statistical processing, may be used.

In addition, as a feature value of speech signal calculated on the basis of learning signals and input signals, the forementioned spectrum feature value is a typical example. This spectrum feature value includes not only envelope information but also power information. However, the learning processing member 10*a* and the speech conversion member 10*b* may calculate other feature values indicating characteristic of an unvoiced sound such as whispering.

Also, as the in-vivo conduction microphone for inputting the signal of non-audible murmur, other than the NAM microphone 2 as a tissue conductive microphone, a bone conductive microphone and a throat microphone may be employed. However, the non-audible murmur is a speech produced from a minimal vibration of vocal tract, and the signal of non-audible murmur can therefore be obtained with high sensitivity by using the NAM microphone 2.

And also, in the above-mentioned embodiment, the microphone 1 for collecting learning output signals is provided separately from the NAM microphone 2 for collecting the signal of non-audible murmur, however, the NAM microphone 2 may double the both microphones.

The present invention can be used in a speech processing device for converting a non-audible speech signal into an audible speech signal.

What is claimed is:

1. A speech processing method for producing an audible speech signal based on and corresponding to an input non-audible speech signal as a non-audible speech signal obtained through an in-vivo conduction microphone, comprising the steps of:

a calculating step of learning signal feature value for calculating a prescribed feature value of each of a learning input signal of non-audible speech recorded by the in-vivo conduction microphone and a learning output signal of audible whisper corresponding to the learning input signal recorded by a prescribed microphone, a learning step for performing learning calculation of a model parameter of a vocal tract feature value conversion model, which, on the basis of a calculation result of the calculating step of learning signal feature value, converts the feature value of a non-audible speech signal into the feature value of a signal of audible whisper, and then storing a learned model parameter in a prescribed storing means, a calculating step of input signal feature value for calculating the feature value of the input non-audible speech signal, a calculating step of output signal feature value for calculating a feature value of a signal of audible whisper corresponding to the input non-audible speech signal, based on a calculation result of the calculating step of input signal feature value and the vocal tract feature value conversion model, with a learned model parameter obtained through the learning step set thereto, and an output signal producing step for producing a signal of audible whisper corresponding to the input non-audible speech signal by employing a signal of a prescribed noise source, on the basis of a calculation result of the calculating step of output signal feature value.

2. The speech processing method according to claim 1, wherein the in-vivo conduction microphone is any of a tissue conductive microphone, a bone conductive microphone and a throat microphone.

3. The speech processing method according to claim 1, wherein the calculating step of input signal feature value and the calculating step of output signal feature value are steps for calculating a spectrum feature value of a speech signal, and the vocal tract feature value conversion model is a model based on a statistical spectrum conversion method.

4. A non-transitory computer readable medium that stores a speech processing program for a prescribed processor to execute producing processing of an audible speech signal based on and corresponding to an input non-audible speech signal as a non-audible speech signal obtained through an in-vivo conduction microphone, comprising the steps of:

a calculating step of learning signal feature value for calculating a prescribed feature value of each of a learning input signal of non-audible speech recorded by the in-vivo conduction microphone and a learning output signal of audible whisper corresponding to the learning input signal recorded by a prescribed microphone, a learning step for performing a learning calculation of a model parameter of a vocal tract feature value conversion model, which, on the basis of a calculation result of the calculating step of learning signal feature value, converts the feature value of a non-audible speech signal into the feature value of a signal of audible whisper, and then storing a learned model parameter in a prescribed storing means, a calculating step of input signal feature value for calculating the feature value of the input non-audible speech signal, a calculating step of output signal feature value for calculating a feature value of a signal of audible whisper corresponding to the input non-audible speech signal, based on a calculation result of the calculating step of input signal feature value and the vocal tract feature value conversion model, with a learned model parameter obtained through the learning step set thereto, and an output signal producing step for producing a signal of audible whisper corresponding to the input non-audible speech signal by employing a signal of a prescribed noise source, on the basis of a calculation result of the calculating step of output signal feature value.

5. A speech processing device for producing an audible speech signal based on and corresponding to an input non-audible speech signal as a non-audible speech signal obtained through an in-vivo conduction microphone, comprising:

a learning output signal storing means for storing a prescribed learning output signal of audible whisper, a learning input signal recording means for recording a learning input signal of non-audible speech input through the in-vivo conduction microphone as a signal corresponding to the learning output signal of audible whisper into a prescribed storing means, a calculating means of learning signal feature value for calculating a prescribed feature value of each the learning input signal and the learning output signal, a learning means for conducting learning calculation of a model parameter of a vocal tract feature value conversion model, which, on the basis of a calculation result of the calculating means of learning signal feature value, converts the feature value of a non-audible speech signal into the feature value of a signal of audible whisper, and then storing a learned model parameter in a prescribed storing means, a calculating means of input signal feature value for calculating the feature value of the input non-audible speech signal, a calculating means of output signal feature value for calculating a feature value of a signal of audible whisper corresponding to the input non-audible speech signal, based on a calculation result of the calculating means of input signal feature value and the vocal tract feature value conversion model, with a learned model parameter obtained through the learning means set thereto, and an output signal producing means for producing a signal of audible whisper corresponding to the input non-audible speech signal by employing a signal of a prescribed noise source, on the basis of a calculation result of the calculating means of output signal feature value.

6. The speech processing device according to claim 5, comprising a learning output signal recording means for recording the learning output signal of audible whisper input through a prescribed microphone into the learning output signal storing means.

* * * * *